US007872623B2

(12) United States Patent
Chen et al.

(10) Patent No.: US 7,872,623 B2
(45) Date of Patent: Jan. 18, 2011

(54) METHOD OF ELIMINATING DISCLINATION OF LIQUID CRYSTAL MOLECULES

(75) Inventors: Kuo-Tzune Chen, Tao-Yuan Hsien (TW); Po-Sheng Shih, Tao-Yuan Hsien (TW)

(73) Assignee: Hannstar Display Corp, Tao-Yuan Hsien (TW)

( * ) Notice: Subject to any disclaimer, the term of this patent is extended or adjusted under 35 U.S.C. 154(b) by 729 days.

(21) Appl. No.: 11/462,812

(22) Filed: Aug. 7, 2006

(65) Prior Publication Data

US 2008/0030448 A1 Feb. 7, 2008

(51) Int. Cl.
*G09G 3/36* (2006.01)

(52) U.S. Cl. ..... 345/87; 345/89; 345/129

(58) Field of Classification Search ..... 345/87, 345/89, 129
See application file for complete search history.

(56) References Cited

U.S. PATENT DOCUMENTS 7,271,789 B2 * 9/2007 Lee et al. ..... 345/87
2004/0196238 A1 * 10/2004 Pfeiffer et al. ..... 345/89

* cited by examiner

*Primary Examiner*—Amare Mengistu
*Assistant Examiner*—Joseph G Rodriguez
(74) *Attorney, Agent, or Firm*—Kirton & McConkie; Evan R. Witt

(57) ABSTRACT

A voltage difference is set between a control electrode and a pixel electrode of a pixel dependent on the gray level of at least one adjacent pixel. A minimum voltage difference, increasing with the gray level of the pixel, is required between the control and the pixel electrodes to prevent disclination. A method of eliminating disclination adjusts the gray level of the pixel and the adjacent pixel to ensure that the voltage difference is greater than the minimum voltage difference, setting the voltage difference into the control and the pixel electrodes, and resetting the potential of the pixel electrode to display the gray level of the pixel without varying the voltage difference between the pixel and the control electrodes. The potential of the control electrode is set to be higher than the potential of the pixel electrode when the polarity of the pixel is positive. The potential of the control electrode is set to be lower than the potential of the pixel electrode when the polarity of the pixel is negative.

11 Claims, 9 Drawing Sheets

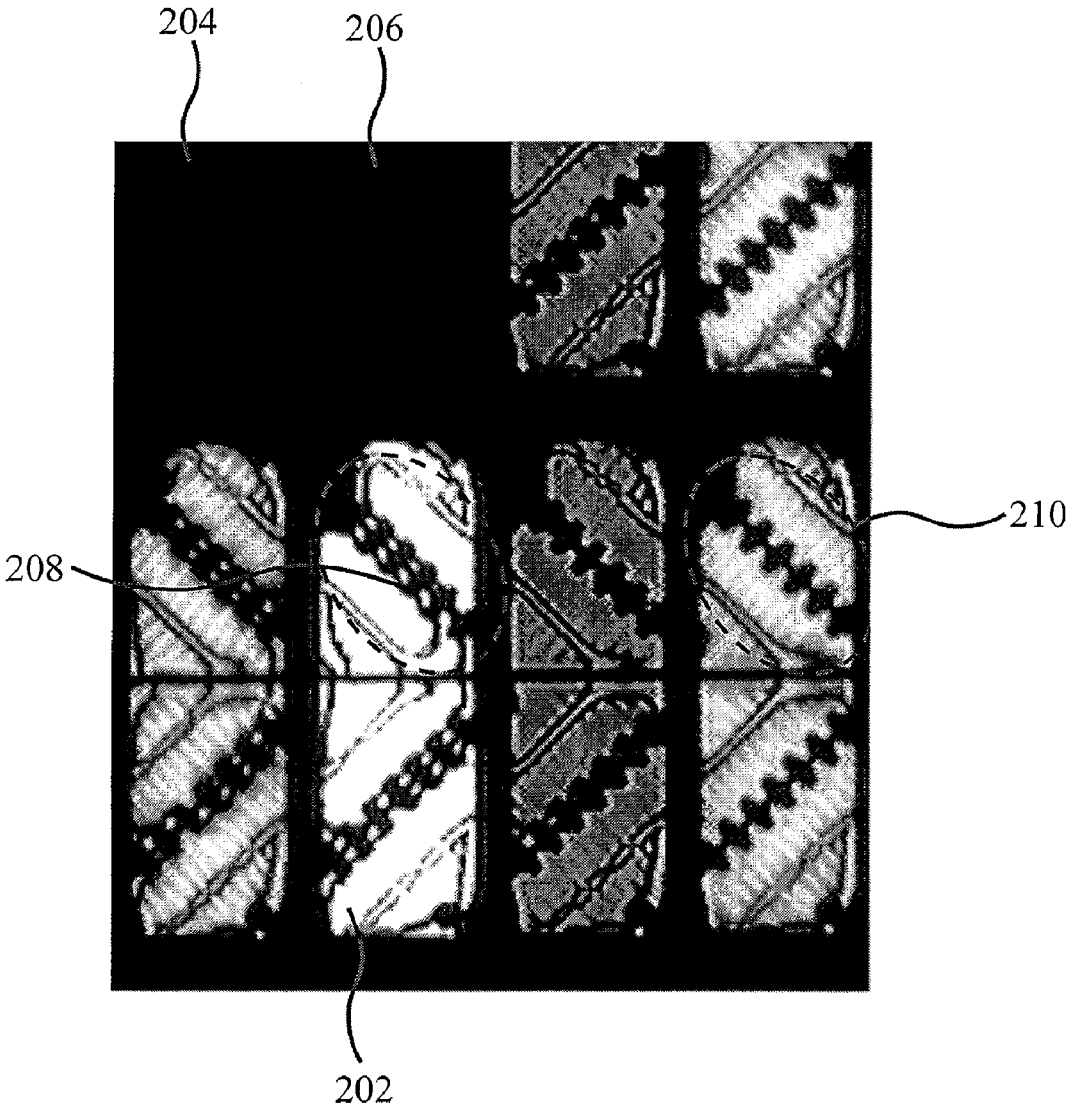
FIG. 2 (RELATED

METHOD OF ELIMINATING DISCLINATION OF LIQUID CRYSTAL MOLECULES

BACKGROUND OF THE INVENTION

1. Field of the Invention

The invention relates to liquid crystal displays, and in particular to the method of eliminating disclination of liquid crystal molecules.

2. Description of the Related Art

FIG. 1 is a cross section diagram of a Bias-Bending Vertical Alignment (BBVA) type manufactured Liquid Crystal Display (LCD) panel. There is only one pixel 10 shown in FIG. 1. The LCD panel comprises a color filter 11, a liquid crystal layer 12, and an active matrix substrate 13. The color filter 11 and the active substrate 13 have a transparent substrate 111 and 131, respectively. The pixel 10 comprises a common electrode 112, a pixel electrode 134, and a control electrode 133. An insulation layer 132 is interposed between the pixel electrode 134 and the control electrode 133. VP, VCE and Vcom symbolize the potential of the pixel electrode 134, the control electrode 133 and the common electrode 112, respectively. The polarity of the pixel 10 is positive when $V_P$ is greater than $V_{com}$. The polarity of the pixel 10 is negative when $V_P$ is less than $V_{com}$. The difference between $V_P$ and $V_{com}$, $|V_P-V_{com}|$, is determined by the gray level of the pixel 10. $V_{com}$ is constant. In pixel 10, the rotation of the liquid crystal molecules 121 are controlled by an electric field generated by the control electrode 133, the pixel electrode 134, and the common electrode 112. To prevent the liquid crystal molecules 121 from rotating reversely, $V_{CE}$ must satisfy the following requirements. First, if the polarity of the pixel 10 is positive, then $V_{CE}$ is greater than $V_P$. Second, if the polarity of the pixel 10 is negative, then $V_{CE}$ is less than $V_P$. Third and last, the voltage difference required between the control and the pixel electrodes (133 and 134) is dependent on the gray level of the pixel 10. The greater the gray level, the greater the required ΔV, wherein $\Delta V \equiv |V_{CE-VP}|$.

If any of the above requirements is not satisfied, the liquid crystal molecules 121 rotate in reverse as shown in area B of FIG. 1, hence, light transmission is reduced. The condition of reversely rotated liquid crystal molecules is referred to as disclination. Disclination results in a lower transmission ratio, a longer response time, and instability in the liquid crystal layer 12.

Published U.S. application US 2005/0083279 A1 disclosed various LCD panels based on the LCD panel of FIG. 1. The embodiments of US 2005/0083279 A1 satisfy the previously described first and second requirements but not the third requirement. The voltage difference between a control electrode and a pixel electrode is determined by several adjacent pixels of the pixel. The gray level of the pixel itself is irrelevant.

FIG. 2 shows several pixels of an embodiment of an LCD panel of US 2005/0083279 A1. The voltage difference between the control and the pixel electrodes of pixel 202 is determined by the gray level of the two adjacent pixels 204 and 206. $\Delta V \equiv |V_{CE}-V_P| = |V_1-V_2|$, where $V_1$ is the potential of a pixel electrode of the adjacent pixel 204, and $V_2$ is the potential of a pixel electrode of the adjacent pixel 206. As shown in FIG. 2, both adjacent pixels 204 and 206 have a low gray level while the pixel 202 has a high gray level, wherein the pixel 202 suddenly changes from low to high gray level. Because the gray level of the adjacent pixels 204 and 206 are low, both $V_1$ and $V_2$ are close to $V_{com}$, and $|V_1-V_2|$ is very small. The pixel 202 requires a large ΔV to satisfy the previously described third requirement and thus prevent disclination. The actual ΔV, which is approximately equivalent to $|V_1-V_2|$, is too small to immediately rotate the liquid crystal molecules in the pixel 202. Disclination occurs in area 208. The backlight cannot completely transmit through the liquid crystal layer in area 208. When comparing area 208 with area 210, the pattern shown in area 208 is less sharp than the pattern shown in area 210, wherein area 210 shows an properly controlled liquid crystal molecule pattern and area 208 shows an improperly controlled liquid crystal molecule pattern. The disclination in area 208 results in image persistence.

BRIEF SUMMARY OF THE INVENTION

The main objective of the invention is to ensure that the voltage difference between control and pixel electrodes is great enough to prevent image persistence shown in area 208 of FIG. 2. The invention simultaneously satisfies the three previously described requirements and provides a novel method of eliminating disclination of liquid crystal molecules.

In this invention, a voltage difference to be set between a control electrode and a pixel electrode of a pixel depends on the gray level of least one adjacent pixel. According to the previously described third requirement, a minimum voltage difference must be kept between the control and the pixel electrodes. The greater the gray level of the pixel, the greater the required minimum voltage difference. The method disclosed in the invention comprises adjusting the gray level of the pixel and the adjacent pixel to ensure that the voltage difference is greater than the minimum voltage difference. After adjusting the gray level, the voltage difference is set into the control and the pixel electrodes. The potential of the control electrode is set higher than the potential of the pixel electrode when the polarity of the pixel is positive. The potential of the control electrode is set lower than the potential of the pixel electrode when the polarity of the pixel is negative. After setting the voltage difference into the control and the pixel electrodes, the potential of the pixel electrode is reset to display the gray level of the pixel, wherein the potential of the control electrode varies simultaneously with the potential of the pixel electrode to maintain the voltage difference therebetween.

The invention also provides another method of eliminating disclination. A maximum gray level difference between a pixel and the adjacent pixel must first be determined. The maximum gray level difference depends on the characteristics and driving method of the LCD panel. In this invention, a voltage difference to be set between a control electrode and a pixel electrode of a pixel is generated according to the gray level of the adjacent pixel. When the gray level of the adjacent pixel is low, the voltage difference to be set between the control and the pixel electrodes is low. If the gray level of the adjacent pixel is smaller than the gray level of the pixel by the maximum gray level difference, the voltage difference produced by the gray level of the adjacent pixel will be too small to prevent disclination. Before driving the pixel, this invention adjusts the gray level of the pixel and the adjacent pixel to ensure the gray level of the pixel being no greater than the gray level of the adjacent pixel by the maximum gray level difference.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein:

FIG. 2 shows image persistence resulting from disclination of liquid crystal molecules;

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
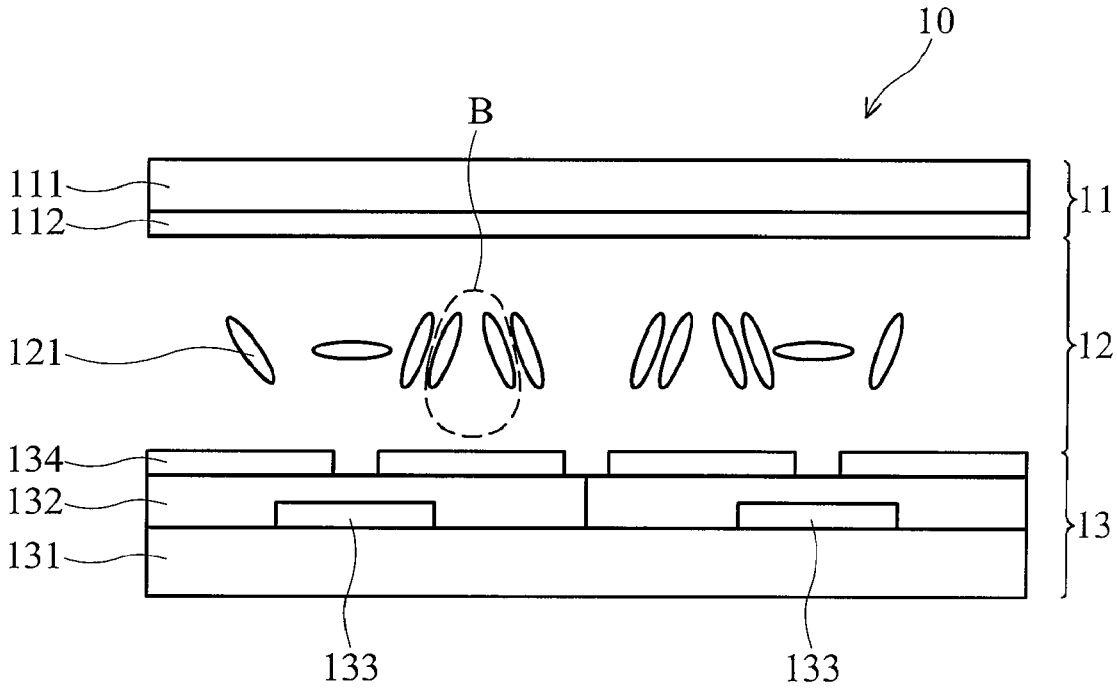
FIG. 1 (RELATED ART)
FIG. 1 is a cross section diagram of a Bias-Bending Vertical Alignment type manufactured LCD panel.
Figure 3A:
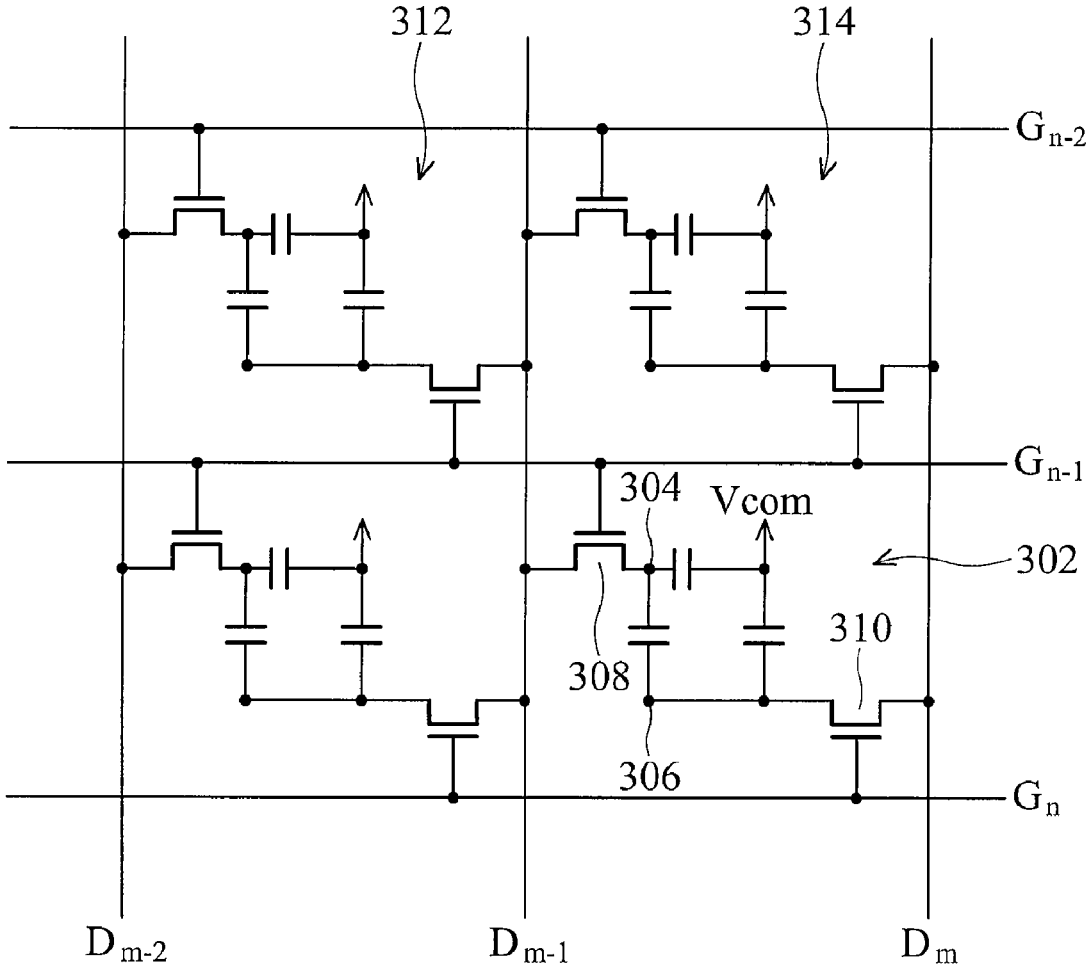
FIG. 3A (RELATED ART)
FIG. 3A shows an LCD panel of US 2005/0083279 A1.
Figure 3B:
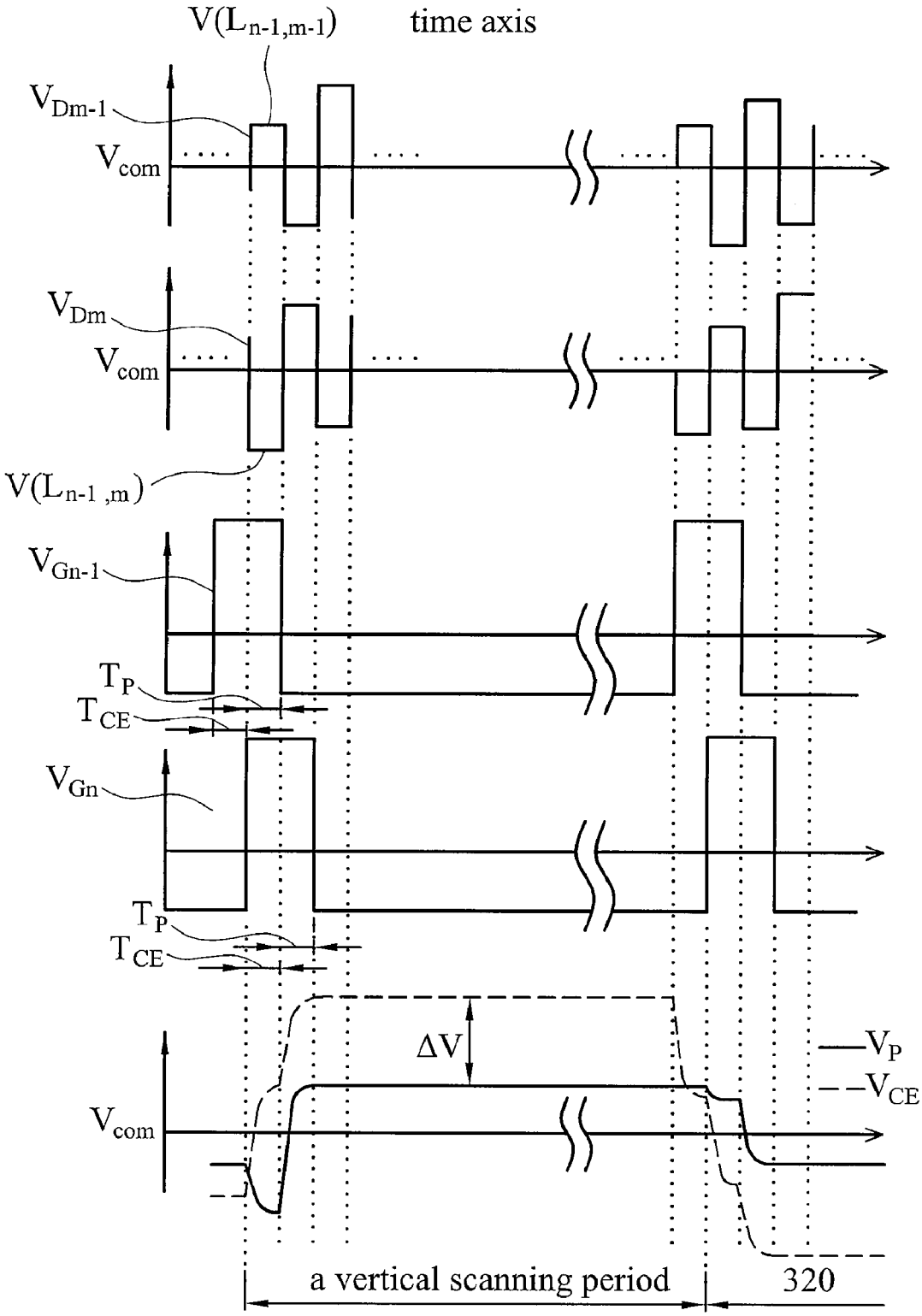
FIG. 3B shows a method of driving the LCD panel illustrated in FIG. 3A.

FIG. 3A is an equivalent circuit diagram of an LCD panel disclosed by US 2005/0083279 A1. A method of driving a pixel 302 at coordinate (n, m) is illustrated in FIG. 3B. $V_{Dm-1}$ and $V_{Dm}$ represent the data signals applied to data lines $D_{m-1}$ and $D_m$, respectively. $V_{Gn-1}$ and $V_{Gn}$ represent scan signals applied to scan lines $G_{n-1}$ and $G_n$, respectively. The lowest waveform in FIG. 3B shows the potential of a control electrode 304 and a pixel electrode 306, symbolized as $V_{CE}$ and $V_P$, respectively. The pixel at coordinate (n-1, m-1) is the first adjacent pixel 312. The pixel at coordinate (n-1, ) is the second adjacent pixel 314. During interval $T_{CE}$ of scan signal $V_{Gn}$, both scan signals $V_{Gn-1}$ and $V_{Gn}$ are high. Thin film transistors 308 and 310 are turned on. The data signals $V_{Dm-1}$ and $V_{Dm}$ are written into the control electrode 304 and the pixel electrode 306, respectively. At this time, the value of $V_{Dm-1}$ is the pixel voltage, $V(L_{n-1,m-1})$, transformed from the gray level of the first adjacent pixel 312, and the value of $V_{Dm}$ is the pixel voltage, $V(L_{n-1,m})$, transformed from the gray level of the second adjacent pixel 314. As shown in the lowest waveform of FIG. 3B, a voltage difference, ΔV, is set between the control and the pixel electrodes 304 and 306 at the end of the interval $T_{CE}$, wherein ΔV is approximately equal to $|V(L_{n-1,m-1})-V(L_{n-1,m})|$. At this time, because the polarity of the first adjacent pixel 312 is positive and the polarity of the second adjacent pixel 314 is negative polarity, $V_{CE}$ is greater than $V_P$ and satisfies the first requirement above ($V_{CE}$ is greater than $V_P$ when the polarity of the pixel 302 is positive). In the next vertical scanning period 320, because the polarity of the first adjacent pixel 312 is negative and the polarity of the second adjacent pixel 314 is positive, $V_{CE}$ is less than $V_P$ and satisfies the second requirement above ($V_{CE}$ is smaller than $V_P$ when the polarity of the pixel 302 is negative). It is clear that US 2005/0083279 A1 satisfies the previously described first and second requirements. During interval $T_P$ of the scan signal $V_{Gn}$, the scan signal $V_{Gn-1}$ is low and the thin film transistor 308 is turned off. The control electrode 304 is in a floating state. At this time, the value of $V_{Dm}$ is the pixel voltage, $V(L_{n,m})$, transformed from the gray level of the pixel 302. $V(L_{n,m})$ is written into the pixel electrode 306. As shown in the lowest waveform of FIG. 3B, $V_{CE}$ varies with $V_P$ to maintain the voltage difference (ΔV) between the control and the pixel electrodes 304 and 306.

Figure 4:
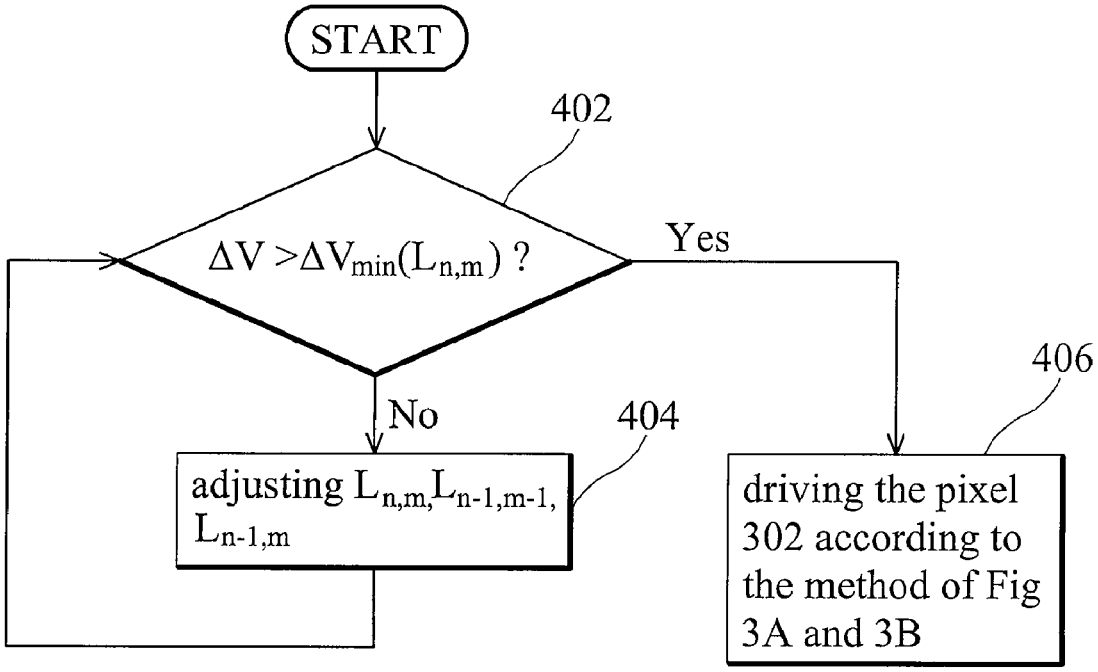
FIG. 4 is a flowchart of the invention.

To ensure that ΔV is large enough to prevent the image persistence shown in area 208 of FIG. 2, the invention adjusts the gray level of an image before displaying it on the LCD panel. FIG. 4 shows a flow chart of one embodiment of the invention. With the method disclosed in FIG. 4, the LCD panel described in FIGS. 3A and 3B can satisfy all requirements for eliminating disclination of liquid crystal molecules. $L_{n,m}$ represents the gray level of a pixel at coordinate (n,m). $L_{n-1,m-1}$ and $L_{n-1,m}$ represent the gray level of adjacent pixels at coordinate (n-1, m-1) and (n-1, m), respectively. $V(L_{n,m})$, $V(L_{n-1,m-1})$ and $V(L_{n-1,m})$ are pixel voltages corresponding to $L_{n,m}$, $L_{n-1,m-1}$ and $L_{n-1,m}$, respectively. $\Delta V_{min}(L_{n,m})$ represents the minimum voltage difference required between the control and the pixel electrodes 304 and 306 to suppress disclination. The value of $\Delta V_{min}(L_{n,m})$ must increase with $L_{n,m}$. As shown in FIGS. 3A and 3B, the voltage difference to be set between the control and the pixel electrodes 304 and 306 is determined by the gray level of the adjacent pixels 312 and 314, wherein $\Delta V=|V(L_{n-1,m-1})-V(L_{n-1,m})$.

In step 402, ΔV is evaluated and compared with $\Delta V_{min}(L_{n,m})$ to determine whether ΔV is greater than $\Delta V_{min}(L_{n,m})$. As shown in step 404, $L_{n,m}$, $L_{n-1,m-1}$, or $L_{n-1,m}$ are adjusted when ΔV is smaller than $\Delta V_{min}(L_{n,m})$. The steps 402 and 404 are repeated until ΔV is greater than $\Delta V_{min}(L_{n,m})$. It is clear from the preceding that the previously described third requirement is always satisfied. In step 406, the method disclosed in FIGS. 3A and 3B is applied to drive the pixel 302. The step of adjusting the gray level may be realized by decreasing $L_{n,m}$, increasing $L_{n-1,m-1}$ or $L_{n-1,m}$, or simultaneously varying $L_{n,m}$, $L_{n-1,m-1}$ and $L_{n-1,m}$.

Figure 5A:
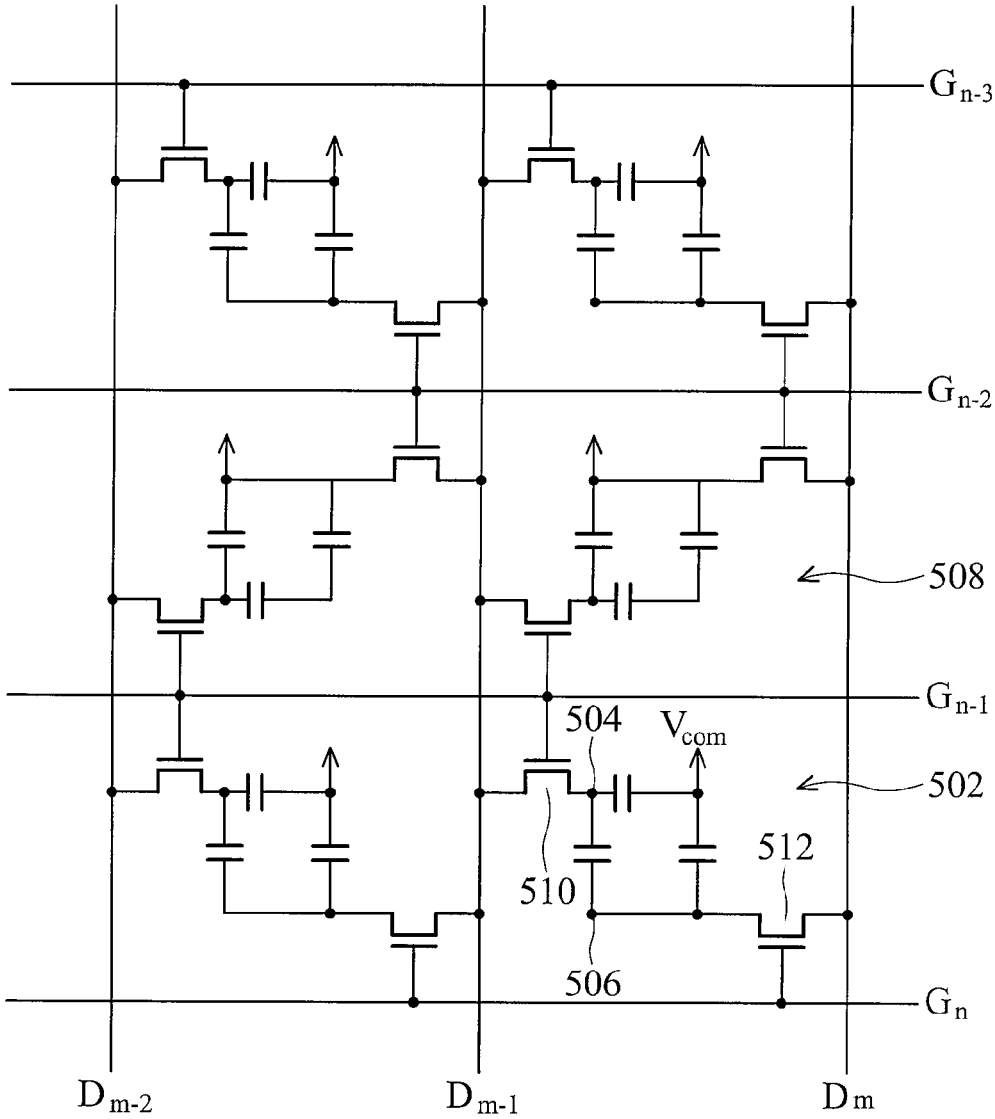
FIG. 5A (RELATED ART)
FIG. 5A shows another LCD panel of US 2005/0083279 A1.
Figure 5B:
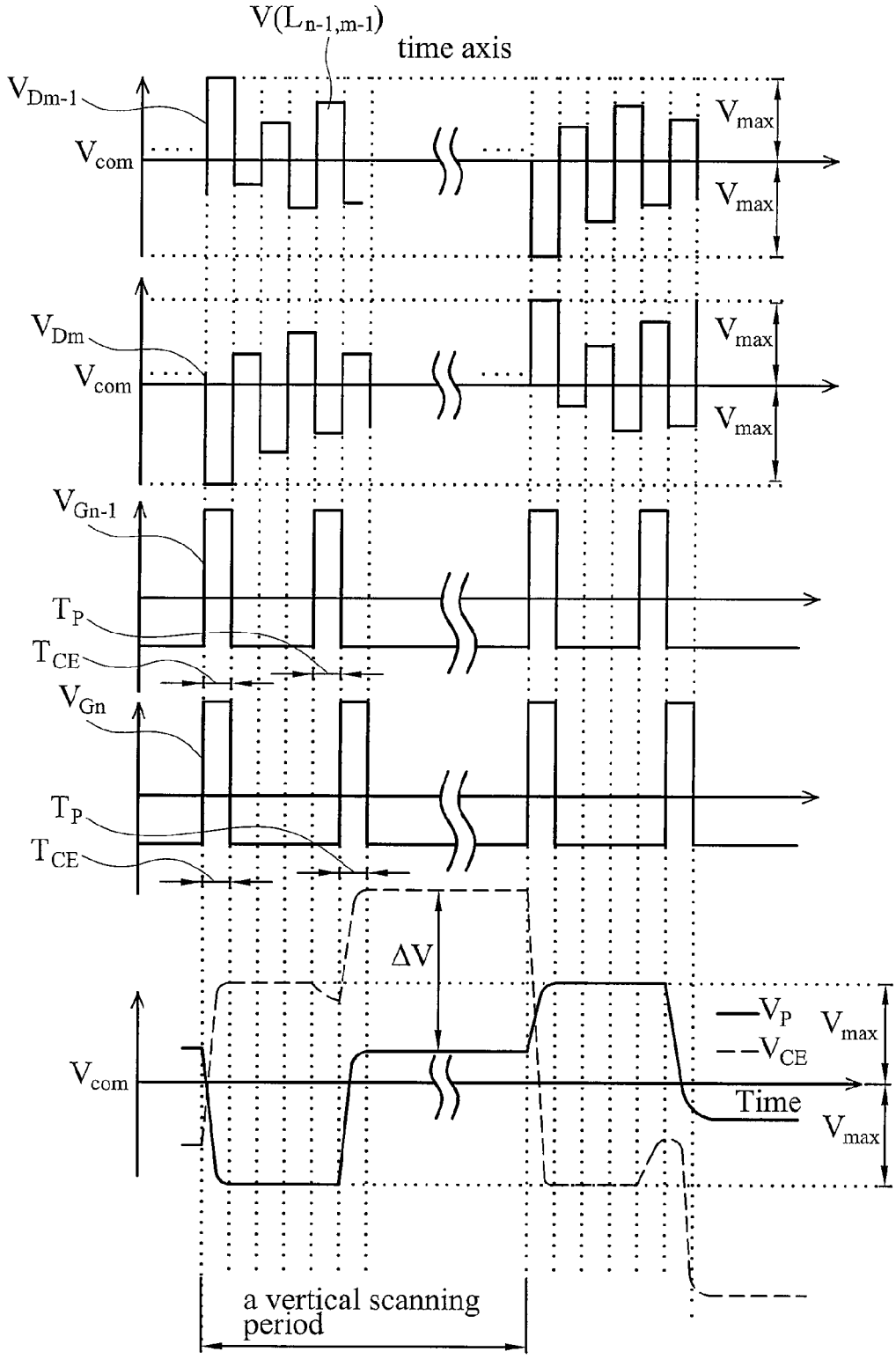
FIG. 5B (RELATED ART)
FIG. 5B shows a method of driving the LCD panel illustrated in FIG. 5A.

FIG. 5A shows another LCD panel disclosed by US 2005/0083279 A1. The configuration of pixels connected to a scan line $G_{n-1}$ is horizontally symmetric to the configuration of pixels connected to a scan line $G_n$. FIG. 5B illustrates a method of driving a pixel 502 to display the gray level thereof. Pixel 508 is adjacent to pixel 502. $V_{Dm-1}$ and $V_{Dm}$ represent the data signals applied to data lines $D_{m-1}$ and $D_m$, respectively. $V_{Gn-1}$ and $V_{Gn}$ represent scan signals applied to scan lines $G_{n-1}$ and $G_n$, respectively. The lowest waveform of FIG. 5B shows the potential of a control electrode 504 and a pixel electrode 506, which are symbolized as $V_{CE}$ and $V_P$. In a vertical scanning period, each scan signal is high in an interval $T_{CE}$ and an interval $T_P$. During the interval $T_{CE}$ of the scan signal $V_{Gn}$, both scan signals $V_{Gn-1}$ and $V_{Gn}$ are high. Data signal $V_{Dm-1}$ is written into the control electrode 504. Data signal $V_{Dm}$ is written into the pixel electrode 506. At this time, the polarity of the pixel 502 is positive, the data signals $V_{Dm-1}$ and $V_{Dm}$ are assigned with a positive $V_{max}$ and a negative $V_{max}$, respectively, to ensure that $V_{CE}$ is greater than $V_P$. During the interval $T_P$ of the scan signal $V_{Gn-1}$, a thin film transistor 510 is turned on and the pixel voltage, $V(L_{n-1,m-1})$, of the adjacent pixel 508 pixel is written into the control electrode 504. As shown in the lowest waveform of FIG. 5B, the variation of $V_{CE}$ during the interval $T_P$ of the scan signal $V_{Gn-1}$ doesn't vary the situation that $V_{CE}$ is greater than $V_P$, and the voltage difference between $V_{CE}$ and $V_P$ is determined by the gray level of the adjacent pixel 508, wherein $\Delta V=V_{max}+|V(L_{n-1,m-1})-V_{com}|$. During interval $T_P$ of the scan signal $V_{Gn}$, the thin film transistor 510 is turned off and the thin film transistor 512 is turned on. The control electrode 504 is in a floating state. The pixel electrode 506 is set to the pixel voltage, $V(L_{n,m})$, of the pixel 502. As shown in the lowest waveform of FIG. 5B, the potential of the control electrode 504 ($V_{CE}$) varies with the potential of the pixel electrode 506 ($V_P$) to maintain their voltage difference, ΔV.

Figure 6:
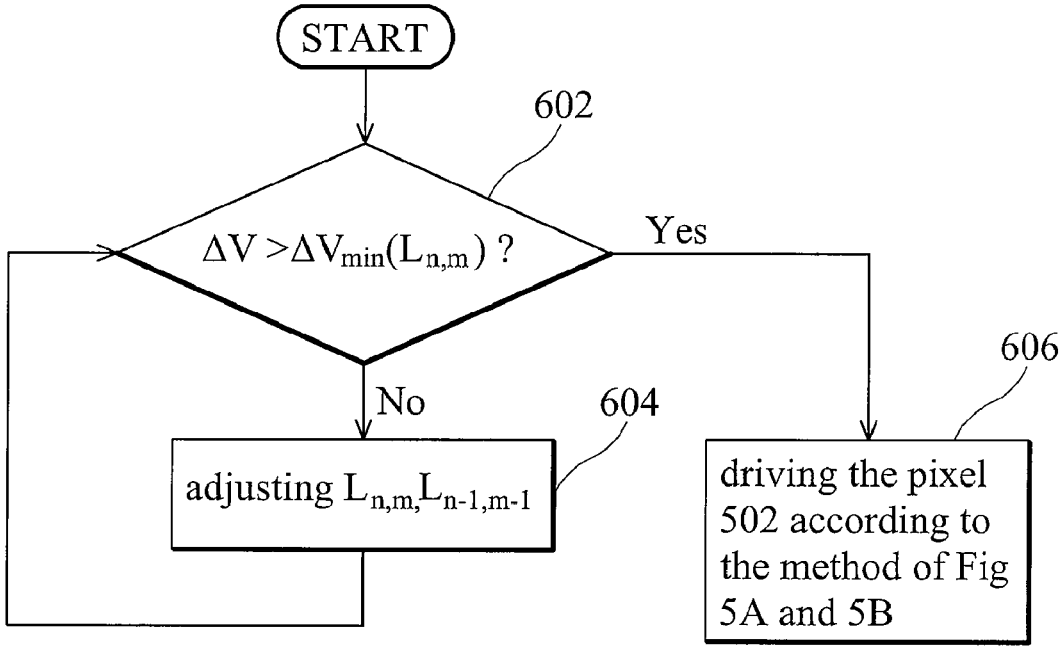
FIG. 6 is a flowchart of the invention.

FIG. 6 shows a flow chart of one embodiment of the invention. With the method disclosed in FIG. 6, the LCD panel described in FIGS. 5A and 5B can satisfy all three of the previously described requirements for eliminating disclination of liquid crystal molecules. $L_{n,m}$ represents gray level of pixel 502. $L_{n-1,m-1}$ represents gray level of the adjacent pixel 508. $V(L_{n,m})$ and $V(L_{n-1,m-1})$ are pixel voltages corresponding to $L_{n,m}$, and $L_{n-1,m-1}$, respectively. $\Delta V_{min}(L_{n,m})$ represents the minimum voltage difference required between the control and the pixel electrodes 504 and 506 to suppress the disclination. $\Delta V_{min}(L_{n,m})$ increases with $L_{n,m}$. As shown in FIGS. 5A and 5B, the voltage difference to be set between the control and the pixel electrodes 504 and 506 is determined by the gray level of the adjacent pixel 508, wherein $\Delta V = V_{max} + |V(L_{n-1,m-1}) - V_{com}|$.

Figure 7:
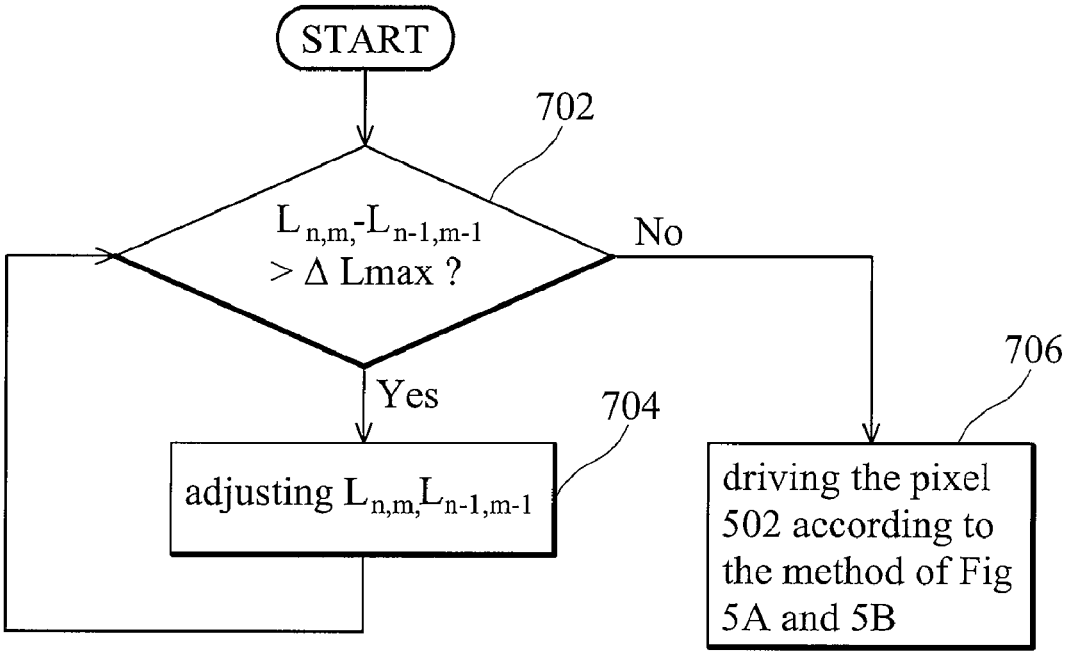
FIG. 7 is a flowchart of the invention.

In step 602, $\Delta V$ are evaluated and compared with $\Delta V_{min}(L_{n,m})$ to determine whether $\Delta V$ is greater than $\Delta V_{min}(L_{n,m})$. As shown in step 604, $L_{n,m}$ or $L_{n-1,m-1}$ is adjusted when $\Delta V$ is smaller than $\Delta V_{min}(L_{n,m})$. The steps 602 and 604 are repeated until $\Delta V$ is greater than $\Delta V_{min}(L_{n,m})$. It is clear from the preceding that the previously described third requirement is always satisfied In step 606, the method disclosed in FIGS. 5A and 5B is applied to drive the pixel 502. The step of adjusting the gray level may be realized by decreasing $L_{n,m}$, increasing $L_{n-1,m-1}$, or simultaneously varying $L_{n,m}$ and $L_{n-1,m-1}$ FIG. 7 is a flow chart of another embodiment of the invention. With the method disclosed in FIG. 7, the LCD panel disclosed in FIG. SA can satisfy all three of the previously described requirements for eliminating disclination that often occurs when $L_{n-1,m-1}$ is small and $L_{n,m}$ is large. $\Delta L_{max}$ is a maximum gray level difference between the pixel 502 and the adjacent pixel 508. $\Delta L_{max}$ is determined by the characteristics, and the driving method of the LCD panel. When $L_{n,m} - L_{n-1,m-1}$ is greater than $\Delta L_{max}$, disclination occurs in the liquid crystal molecules of the pixel 502. $\Delta L_{max}$ may vary with the gray level of the pixel 502. In step 702, $L_{n,m}$ is compared with $L_{n-1,m-1}$. As shown in text 704, when $L_{n,m} - L_{n-1,m-1}$ is greater than $\Delta L_{max}$, $L_{n,m}$ and $L_{n-1,m}$ are adjusted to limit their gray level difference. The steps 702 and 704 are repeated until $L_{n,m} - L_{n-1,m-1} \leqq \Delta L_{max}$. It is clear from the preceding that the previously described third requirement is always satisfied. In step 706, the method disclosed in FIGS. 5A and 5B is applied to drive the pixel 502. The step of adjusting the gray level may be realized by decreasing $L_{n,m}$, increasing $L_{n-1,m-1}$, or simultaneously varying $L_{n,m}$ and $L_{n-1,m-1}$.

Another embodiment of the invention adjusts the gray level of every pixel in an image before driving the LCD panel to display the image. The LCD panel may be an embodiment of US 2005/0083279 A1 or any equivalent LCD panel. The step of adjusting the gray level of the image is operative to ensure that the three previously described requirements are satisfied. The invention offers excellent image contrast by only changing the gray level of pixels violating the previously described third requirement.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method of eliminating disclination of liquid crystal molecules, comprising the following steps of:

(a1) evaluating a voltage difference to be set between a control electrode and a pixel electrode of a first pixel, wherein the voltage difference is determined by a gray level of a second pixel adjacent to the first pixel;

(b1) determining whether the voltage difference is greater than a minimum voltage difference which is determined according to a gray level of the first pixel so as to suppress disclination;

(c1) adjusting either the gray level of the first pixel to change the minimum voltage difference or the gray level of the second pixel to change the voltage difference if the voltage difference is smaller than the minimum voltage difference, and returning to the step (b1); and (d1) setting the voltage difference into the control and the pixel electrodes if the voltage difference is greater than the minimum voltage difference, wherein the potential of the control electrode is set higher than the potential of the pixel electrode when the polarity of the first pixel is positive, and the potential of the control electrode is set lower than the potential of the pixel electrode when the polarity of the first pixel is negative.

2. The method as claimed in claim 1, wherein in the step (b1) the minimum voltage difference is increased with the gray level of the first pixel.

3. The method as claimed in claim 1 further comprising a step of:

(e1) resetting the potential of the pixel electrode to display the gray level of the first pixel, wherein the potential of the control electrode varies simultaneously with the potential of the pixel electrode to maintain the voltage difference therebetween.

4. The method as claimed in claim 1, wherein in the step (c1) adjusting the gray level of the first pixel is realized by decreasing the gray level of the first pixel.

5. The method as claimed in claim 1, wherein in the step (a1) the voltage difference increases as the gray level of the second pixel increases.

6. The method as claimed in claim 5, wherein in the step (c1) adjusting the gray level of the second pixel is realized by increasing the gray level of the second pixel.

7. A method of eliminating disclination of liquid crystal molecules, comprising the following steps of:

(a2) evaluating a gray level difference between a gray level of a first pixel and a gray level of a second pixel adjacent to the first pixel;

(b2) determining whether the gray level difference is greater than a maximum gray level difference which is determined by the characteristics and driving way of a LCD panel to prevent disclination;

(c2) adjusting either the gray level of the first pixel or the gray level of the second pixel to change the gray level difference if the gray level difference is greater than the maximum gray level difference, and returning to the step (b2); and (d2) generating a voltage difference between a control electrode and a pixel electrode of the first pixel according to the gray level of the second pixel if the gray level difference is less than the maximum gray level difference, wherein the potential of the control electrode is set higher than the potential of the pixel electrode when the polarity of the first pixel is positive, and the potential of the control electrode is set lower than the potential of the pixel electrode when the polarity of the first pixel is negative.

8. The method as claimed in claim 7 further comprising a step of:

(e2) resetting the potential of the pixel electrode to display the gray level of the first pixel, wherein the potential of the control electrode varies simultaneously with the potential of the pixel electrode to maintain their voltage difference.

9. The method as claimed in claim 7, wherein in the step (c2) adjusting the gray level of the first pixel is realized by decreasing the gray level of the first pixel.

10. The method as claimed in claim 7, wherein in the step (d2) the voltage difference increases as the gray level of the second pixel increases.

11. The method as claimed in claim 10, wherein in the step (c2) adjusting the gray level of the second pixel is realized by increasing the gray level of the second pixel.

* * * * *